US007739024B2

(12) United States Patent
Augesky et al.

(10) Patent No.: US 7,739,024 B2
(45) Date of Patent: Jun. 15, 2010

(54) CONTROLLER FOR OPERATING AT LEAST ONE FUEL INJECTOR OF AN INTERNAL COMBUSTION ENGINE

(75) Inventors: Christian Augesky, Vienna (AT); Martin Götzenberger, Ingolstadt (DE)

(73) Assignee: Continental Automotive GmbH, Munich (DE)

( * ) Notice: Subject to any disclaimer, the term of this patent is extended or adjusted under 35 U.S.C. 154(b) by 197 days.

(21) Appl. No.: 12/065,562

(22) PCT Filed: Jul. 19, 2006

(86) PCT No.: PCT/EP2006/064424

§ 371 (c)(1),
(2), (4) Date: Mar. 3, 2008

(87) PCT Pub. No.: WO2007/025801

PCT Pub. Date: Mar. 8, 2007

(65) Prior Publication Data

US 2008/0221779 A1 Sep. 11, 2008

(30) Foreign Application Priority Data

Sep. 2, 2005 (DE) ..... 10 2005 041 823

(51) Int. Cl.
*F02D 41/20* (2006.01)
*F02M 51/00* (2006.01)

(52) U.S. Cl. ..... 701/103

(58) Field of Classification Search ..... 701/103–105, 701/102, 115; 123/478, 480, 494, 490, 472; 251/129.1, 129.09; 239/585.1
See application file for complete search history.

(56) References Cited

U.S. PATENT DOCUMENTS

| | | | | |
|---|---|---|---|---|
| 4,668,872 | A * | 5/1987 | Lerouge et al. | 123/350 |
| 5,909,348 | A | 6/1999 | Zydek et al. | |
| 5,992,391 | A * | 11/1999 | Yamakado et al. | 123/490 |
| 6,232,781 | B1 | 5/2001 | Goser et al. | |
| 6,310,470 | B1 | 10/2001 | Hebing et al. | |
| 6,431,155 | B1 * | 8/2002 | Yamakado et al. | 123/490 |
| 6,437,954 | B1 | 8/2002 | Harr | |

(Continued)

FOREIGN PATENT DOCUMENTS

| | | | |
|---|---|---|---|
| DE | 3942164 | A1 | 6/1990 |

(Continued)

*Primary Examiner*—Hieu T Vo
(74) *Attorney, Agent, or Firm*—Laurence A. Greenberg; Werner H. Stemer; Ralph E. Locher

(57) ABSTRACT

To simplify reliable detection of operating faults in a control unit for operating an electrical component (for example, a fuel injector), an end stage is provided on the output side and is provided with a first line section and a second line section for supplying current in a synchronized manner to an electrical consumer which can be connected to the two line sections via an external line pair. A detection coil configuration is provided for detecting operating faults on the basis of an evaluation of a current that is induced at the detection coil configuration. The detection coil configuration is flowed through by a magnetic flux that is composed of magnetic flow components which are caused by the current flows in the two line sections, and wherein mutual compensation of the magnetic flow components is provided in a normal mode.

13 Claims, 4 Drawing Sheets

U.S. PATENT DOCUMENTS

| | | | |
|---|---|---|---|
| 6,483,681 | B1 | 11/2002 | Bauer |
| 6,489,778 | B2 | 12/2002 | Martin |
| 6,563,252 | B2 | 5/2003 | Schrod |
| 6,700,301 | B2 | 3/2004 | Rueger et al. |
| 7,525,783 | B2 | 4/2009 | Chemisky et al. |
| 2004/0264216 | A1 | 12/2004 | Mednik et al. |

FOREIGN PATENT DOCUMENTS

| | | | |
|---|---|---|---|
| DE | 4124190 | A1 | 1/1993 |
| DE | 19526435 | A1 | 12/1996 |
| DE | 19748550 | A1 | 10/1998 |
| DE | 19735412 | A1 | 2/1999 |
| DE | 19735743 | A1 | 2/1999 |
| DE | 19850001 | A1 | 5/2000 |
| DE | 19944733 | A1 | 3/2001 |
| DE | 10033196 | A1 | 1/2002 |
| DE | 10158553 | A1 | 6/2002 |
| DE | 19723456 | C2 | 3/2003 |
| DE | 10256456 | A1 | 7/2004 |
| DE | 10303779 | A1 | 7/2004 |
| GB | 2228106 | A | 8/1990 |

* cited by examiner

CONTROLLER FOR OPERATING AT LEAST ONE FUEL INJECTOR OF AN INTERNAL COMBUSTION ENGINE

BACKGROUND OF THE INVENTION

Field of the Invention

The present invention relates to a controller as claimed in the preamble to claim 1, for operating at least one injector for injecting fuel into a combustion chamber of an internal combustion engine.

A controller of this kind is known from DE 199 44 733 A1, DE 101 58 553 A1 and DE 103 03 779 A1. In this prior art there is provided a control circuit for controlling a plurality of fuel injectors by means of an output stage which can be connected on the output side via external lines to piezoelectric actuators ("piezo actuators") each constituting an electrical (capacitive) load. To control the respective fuel injector, current is supplied to each such electrical load via a line pair.

The problem generally with supplying current from a controller to electrical components via external lines is that these lines running from the controller to the load pose a greater or lesser risk to correct operation. In many applications, these lines are subject, for example, to an increased short-circuit risk. In automotive controllers, such as so-called engine control units which are used to operate vehicle electrical components, fault currents and/or short circuits may occur e.g. due to wear, mistreatment, etc. Such unwanted current paths can be produced both between the lines of a corresponding line pair and between such a line and another vehicle part which is connected e.g. to a vehicle electrical system voltage (e.g. battery voltage) or to vehicle ground.

Detecting such faults, e.g. to initiate appropriate protective measures, involves a greater or lesser degree of complexity. This complexity is especially high particularly if the power characteristics of the output stage are demanding, as is generally the case e.g. for output stages for supplying current to actuators of a fuel injector arrangement in internal combustion engines.

DE 197 23 456 C2 discloses a fault detection device for electrical loads, wherein there is provided a measuring and diagnostic device for detecting faults at the electrical load to which a load current is supplied via a power output stage. The measuring device consists of a two-resistor voltage divider whose tap is connected to a load terminal. The voltage present at this tap is fed to the diagnostic device in order to compare it with a reference voltage.

DE 100 33 196 A1 discloses a method and a device for detecting a fault current at an injection valve. During injection or in an injection pause when the piezo actuator is charged, the voltage characteristic or an actuator voltage change is measured and, if a predefined threshold value is exceeded, a fault indication is produced and/or the piezo actuator is disconnected.

DE 195 26 435 A1 describes a circuit arrangement for detecting a fault current or leakage current on a supply line. For fault current detection, the potential present on the supply line as a result of the leakage current when the supply voltage is disconnected is determined and evaluated using a potential monitor.

DE 198 50 001 A1 discloses a fault current detection system for a control unit with a load (e.g. solenoid valve) connected to an output of the control unit. In this prior art, a fault current is present when a load current does not flow from the control unit output to the load, but from the load to the control unit output, which is detected by a transistor arrangement provided in the controller.

DE 197 35 412 A1 describes a fault current protection device by means of which a multiphase supply is monitored for AC and pulsed fault current. The device comprises two fault current tripping circuits each connected to the secondary winding of an assigned summation current transformer, primary windings of this summation current transformer providing a flow path for the several phases of the multiphase load current.

DE 41 24 190 A1 discloses a method for monitoring and switching off a supply system having at least one outgoing conductor and one return conductor (zero conductor) if a current difference occurs in the outgoing and return conductor because of a leakage or ground fault current, the current difference being measured by means of a sensor which produces a signal corresponding to the difference which is fed to an evaluation circuit. According to the exemplary embodiment described in this publication, the sensor is implemented as a toroidal core current transformer in which a supply system line with one outgoing and one return conductor is fed through as a primary winding and the secondary winding is connected to the evaluation circuit.

DE 197 35 743 A1 discloses a fault current protection device. The device comprises a summation current transformer in which a voltage signal indicative of the fault is induced in the secondary winding.

DE 197 48 550 A1 discloses a method for measuring electrical currents in conductors. For this current measurement, which can also be used for fault detection (e.g. in respect of overcurrent and/or fault current), magnetoresistive sensors (not described in further detail) are used. These sensors can be coupled to the conductors via flux concentrators (not described in further detail) to increase the magnetic field sensitivity. In an exemplary embodiment, a sensor is disposed as a sensor chip on one side of a planarly extended insulator, on the opposite side of which the electrical conductors are disposed.

BRIEF SUMMARY OF THE INVENTION

The object of the present invention is to simplify the reliable detection of operating faults for a controller of the type mentioned in the introduction.

According to a first aspect of the present invention, this object is achieved by a controller as claimed in claim 1.

At the controller, output-side line sections of the output stage run close to a magnetic flux part such that magnetic flux components produced in the magnetic flux part by the current flows in the two line sections during normal operation essentially are mutually compensating. If during normal operation the currents flowing via the two line sections are equal in terms of absolute value but are of opposite sign in the sense that one current flows in the direction of the load (=actuator) and the other current flows back from the load, this compensation of the magnetic flux components produced can be ensured in a simple manner by a suitable geometry of the arrangement. Because of the superposition principle applicable to the generation of magnetic fields by current flows (as expressed e.g. in the Biot-Savart Law), this compensation or rather the degree of this compensation is independent of the absolute value of the current flowing via the line sections. By means of a suitably symmetrical configuration of the line sections, of the magnetic flux part and their mutual arrangement, it can be achieved, for example, that the two magnetic flux components possess an opposite orientation and essentially or completely cancel each other out. For operating fault detection of the kind mentioned in the introduction, there is provided according to the first aspect of the invention a detection coil arrangement permeated by the magnetic flux of the magnetic flux part, enabling said operating faults to be detected on the basis of evaluation of a voltage induced on the detection coil arrangement. That is to say, in the event of a fault where a more or less large current does not only flow via the outgoing or return line but also at least partly via an unwanted current path at a potential of the installation environment in question, the (signed) sum of the outgoing and return current is non-zero. According to the abovementioned superposition principle, this in turn means that (as the sum of the now unequal absolute values of the magnetic flux components) there is produced in the magnetic flux section a resulting magnetic flux which can be detected in a simple manner on the basis of the pulsed supply of current by means of the detection coil arrangement or, more specifically, evaluation of the voltage induced thereon.

Particularly in order to make the voltage induced on the detection coil arrangement highly sensitive to fault currents, it is advantageous if the magnetic flux part is made of magnetically soft material. Such materials will be well-known to the average person skilled in the art from the field of transformers and converters and therefore require no further explanation here. Particularly suitable, for example, are materials for producing so-called ferrite cores. Using such materials, the magnetic flux components produced by the two current flows can be concentrated particularly efficiently onto the spatial area of the magnetic flux part, which is in turn extremely advantageous for high efficiency of the induction used for fault detection in the area of the detection coil arrangement.

In one embodiment it is provided that the magnetic flux part is designed to surround the two line sections in an essentially annularly closed manner. On the one hand this again enables the spatial concentration of the magnetic flux to be improved. On the other hand it enables a symmetry, already mentioned above, of the overall arrangement to be achieved in respect of magnetic flux compensation for a large number of geometries of the two line sections. This will now be explained using an example: if the two line sections are each formed by a single conductive trace of a circuit board, said conductive traces running in different interconnection levels and with opposite directions of current flow, magnetic flux components produced in a magnetic flux part provided on only one face of the circuit board could only compensate each other inadequately (as the distances between line section and magnetic flux part are different for the two line sections). Here a compensating geometry can be created in a simple manner by making the magnetic flux part also extend on the other side of the circuit board, whether it be in a more or less continuous manner, e.g. bipartite or annularly closed.

In one embodiment it is provided that the magnetic flux part has at least one section which is mounted to a circuit board. A circuit board suitable for this purpose is generally provided anyway for a controller of the type of interest here. This measure can advantageously be combined with the abovementioned embodiment of the line sections as conductive traces of this very circuit board. The magnetic flux part can be mounted e.g. to a face of the circuit board.

The circuit board can also be provided with one or more cutouts which are partly or completely engaged or rather penetrated by the magnetic flux part. With such cutouts it is readily possible to provide a completely closed magnetic flux ring which is composed, for example, of two halves which in the mounted state extend on or over opposite faces of the circuit board and abut one another in the area of the cutouts (with or without air gap).

According to a second aspect of the present invention, the above object is achieved by a controller as claimed in claim 5.

With this controller, the output-side line sections of the output stage run in such a way that magnetic flux components produced by the current flows in the two line sections during normal operation essentially compensate each other in a spatial area adjacent to the line sections. As in the case of the first aspect of the invention, the magnetic flux component compensation provided during normal operation can again be ensured in a simple manner by a suitable geometry of the arrangement, this compensation or rather the degree of this compensation again being independent of the absolute value of the current flowing via the line sections. By means of a suitably symmetrical configuration of the line sections and their mutual disposition it can be achieved, for example, that the two magnetic flux components possess an opposite orientation at a defined location and essentially or completely cancel one another out. To detect operating faults of the kind mentioned in the introduction, there is provided according to the second aspect of the invention a detection coil arrangement permeated by the magnetic flux in the spatial area so that, similarly to the first aspect of the invention, by evaluating the induced voltage, the event of a more or less large "fault current" flowing can again be detected as an operating fault.

The measures provided according to the invention for detecting a fault are in practice particularly reliable and can be implemented in a particularly simple and robust manner. Particularly demanding electrical power characteristics of the controller or more especially of the output stage contained therein are no obstacle thereto. Thus the application of the invention is particularly useful for output stages in which, when current is supplied to the load, at least periodically under normal operating conditions a comparatively high voltage (e.g. more than 100 V) is generated and/or a comparatively high current (e.g. greater than 2 A) is generated and/or a comparatively high pulse frequency of the supplied current (e.g. greater than 10 kHz) is provided.

A preferred use of the controller according to the invention is therefore for the pulsed supply of current to fuel injectors for which a fuel injection valve is actuated by charging and discharging a piezo actuator.

In one embodiment, which is particularly attractive for controlling a plurality of fuel injectors of an internal combustion engine, at least one of the two line sections can be connected to one of a plurality of external lines via a selector switch arrangement. Advantageously, the relevant line section which is connected to the plurality of external lines via a selector switch arrangement can be used jointly for the corresponding plurality of loads (=actuators) within the scope of the inventive fault detection system.

In one embodiment, the two line sections are implemented symmetrically with respect to one another. If a magnetic flux part is provided, the line sections can run parallel to each another (in particular in a straight line) e.g. in the vicinity of said magnetic flux part on both sides of a plane of symmetry running between the line sections. In order to ensure in this case the desired compensation of the magnetic flux components produced in the magnetic flux part, it can be provided, for example, that said plane of symmetry defines a symmetry of the magnetic flux part. However, the symmetrical embodiment of the line sections can also be advantageously used in respect of the compensation required during normal operation if no magnetic flux part is employed.

In a preferred embodiment it is provided that the two line sections are implemented as conductive traces, particularly parallel-running conductive traces, of a circuit board. These conductive traces can run "side by side" in one and the same interconnection level. Alternatively or additionally, if the circuit board has a plurality of interconnection levels, the conductive traces can also run "one above the other".

The magnetic flux component compensation required for normal operation can be most simply implemented by a corresponding symmetry of the line sections and their disposition relative to the spatial area or more specifically of the magnetic flux part (if present). In this respect, in the case of the above mentioned embodiment of the line sections as conductive traces of a circuit board, it is provided in a preferred embodiment that the arrangement of the conductive traces has a high degree of symmetry. If e.g. a circuit board with a plurality of interconnection levels is used, line sections running in different interconnection levels can be disposed e.g. symmetrically with respect to a central plane of the circuit board. For example, one of the line sections can be implemented at the highest interconnection level, whereas the other line section is implemented at the lowest interconnection level.

If no magnetic flux part is provided, an embodiment with line sections running in a curved and/or angled manner is advantageous. This means that, in per se known manner, the magnetic field produced by each line section can be better "concentrated" in the spatial area. For example, the line sections can each be approximately U-shaped. In respect of the compensation desired during normal operation, for example, an embodiment with line sections running congruently one above the other is advantageous. If not only the line sections but also at least one detection coil are implemented as conductive traces of a multilayer circuit board, it is advantageous to provide the detection coil trace inside the circuit board and more or less "cover" them on both sides by the traces of the line sections. This enables the line sections to act e.g. as shielding of the detector coil from interfering fields.

In one embodiment of the invention it is provided that the detection coil arrangement comprises at least one detection coil formed by a conductive trace of a circuit board. This then results in a particularly simple and compact design if the line sections are also implemented as conductive traces of said circuit board. A one-piece or multi-piece magnetic flux part (if present) can be easily mounted to this circuit board.

In one embodiment there is provided, for example, a circuit board having four interconnection levels, in which circuit board there is implemented at the highest and lowest interconnection level a detection coil formed by a conductive trace, whereas the central interconnection levels inside the circuit board are used to implement the two conductor sections. A magnetic flux part designed to surround the two line sections in an essentially annularly closed manner can then consist e.g. of two half-rings which are mounted (e.g. bonded) to opposite faces of the circuit board, the two induction coils each enclosing a section of the magnetic flux part in a spiral manner.

In one embodiment it is provided that the evaluation of the induced voltage involves measuring a voltage drop across a resistive element connected in series with a detection coil of the detection coil arrangement.

If evaluation of the induced voltage indicates a fault, it can be provided, for example, that this is signaled, registered in an electronic diagnostic storage device and/or the output stage is placed in a safe mode, in particular e.g. disconnected completely.

The invention will now be described in greater detail on the basis of exemplary embodiments and with reference to the accompanying drawings in which:

DESCRIPTION OF THE INVENTION

Figure 1:
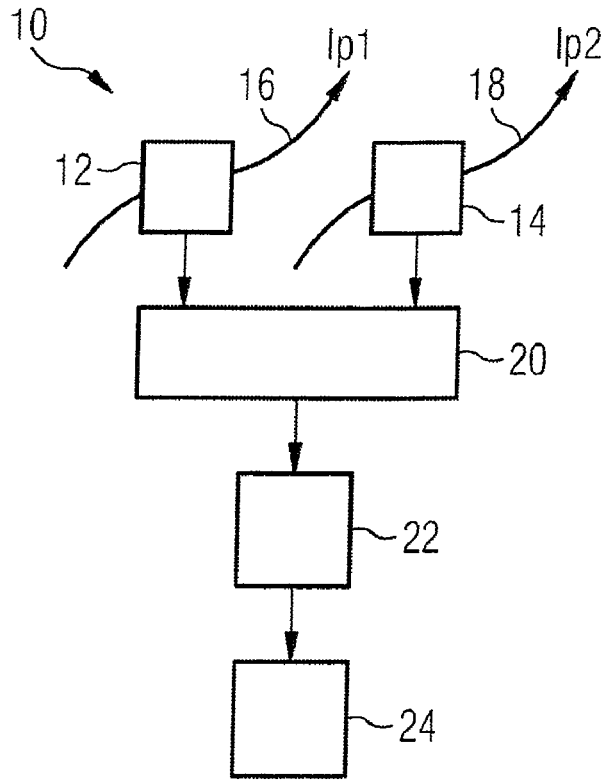
FIG. 1 shows a block diagram of some components in a controller which are used to detect operating faults.

FIG. 1 shows an arrangement denoted altogether by the reference numeral 10 for the detection of faults for a controller for operating fuel injectors, the controller comprising an output stage provided at the output side with a first line section 12 and a second line section 14 for the pulsed supply of current to an electric actuator (e.g. piezo actuator) connected to the two line sections 12, 14 of the output stage via an external line pair 16, 18.

The output stage (not shown in FIG. 1) of the controller produces a current flowing via the two line sections 12, 14 and the associated external lines 16, 18 to control the fuel injector, the signed sum of the two currents designated Ip1 and Ip2 in FIG. 1 being zero under normal operating conditions. For example, an "outgoing current" Ip1 flowing via the line section 12 and the first line 16 results in an opposite but, in terms of absolute value, equal "return current" Ip2 (Ip2=−Ip1).

The two line sections 12, 14 are implemented and disposed near a magnetic flux part (e.g. ferrite rod or ring) 20 in such a way that during such normal operating conditions the magnetic flux components produced by the equal and opposite current flows Ip1, Ip2 essentially cancel each other out in the magnetic flux part 20. The generation in each case of a magnetic flux component by the currents flowing in the sections 12, 14 is symbolized in the figure by appropriate arrows.

The total magnetic flux produced as the sum of these magnetic flux components in the magnetic flux part 20 is consequently normally zero.

However, if a fault occurs in the area of the external conductors 16, 18, resulting in the sum of the two currents Ip1 and Ip2 no longer being zero, as may be caused e.g. by a leakage current path or short-circuiting of one of the conductors to an external part acting as a current source or sink, this will be detected by the arrangement 10.

To detect such operating faults, there is provided a detection coil arrangement 22 permeated by the magnetic flux of the magnetic flux part 20, an appreciable voltage being induced in said arrangement in the event of a fault. This induction is symbolized in the figure by a corresponding arrow between the magnetic flux part 20 and the coil arrangement 22, detection of the operating fault being based on evaluation of the induced voltage by an evaluation device 24 connected to the coil arrangement 22.

Figure 2:
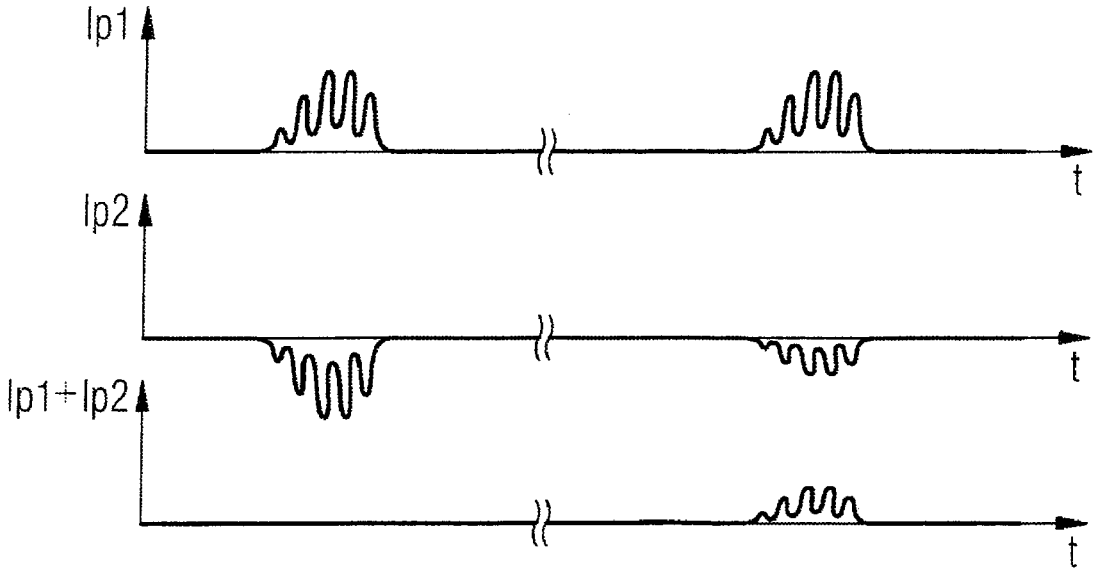
FIG. 2 shows examples of electric currents as a function of time in the controller.

FIG. 2 shows in its left-hand part an example of the characteristic of a pulsed "outgoing current" Ip1, the resulting equal and opposite "return current" Ip2 and the sum Ip1+Ip2 as a function of time t. During normal operation the latter sum is always zero. Consequently no voltage is induced on the detection coil arrangement 22.

This changes in the event of a fault, when e.g. part of the outgoing current Ip1 is taken up by an unwanted external sink and the absolute value of the return current Ip2 is accordingly reduced proportionally. This event is shown in the right-hand part of the figure and results in the situation that the sum Ip1+Ip2 is no longer constantly zero, as shown in the lower right part of the figure. This sum has a pulsating characteristic as a function of time. Consequently the magnetic flux will also pulsate in the magnetic flux part 20, in turn resulting in a corresponding voltage being induced on the detection coil arrangement 22, which is registered by the evaluation device 24 as indicating a fault.

Figure 3:
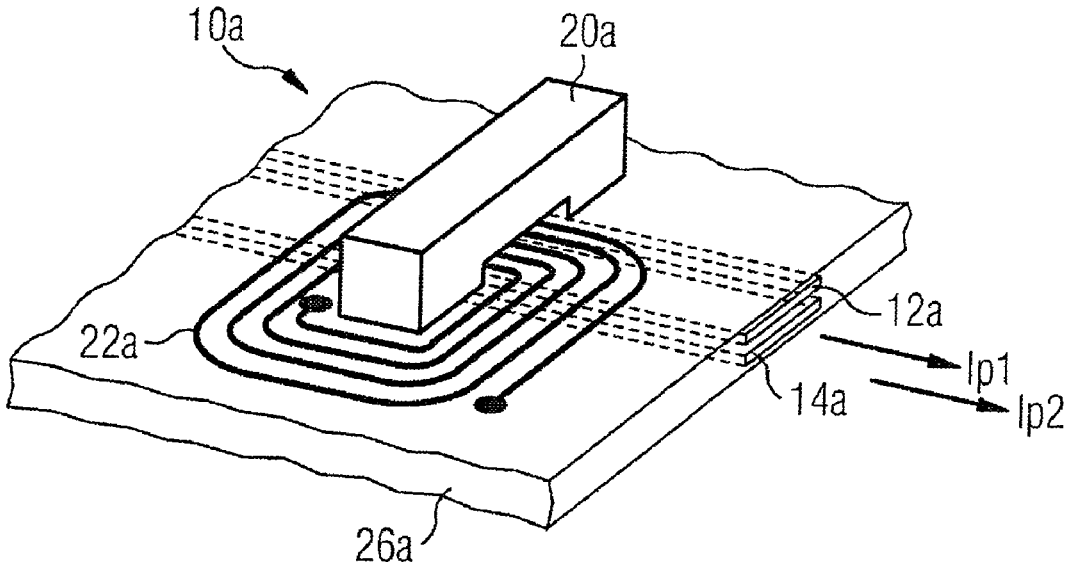
FIG. 3 is a perspective view of some components of a controller according to another embodiment.
Figure 4:
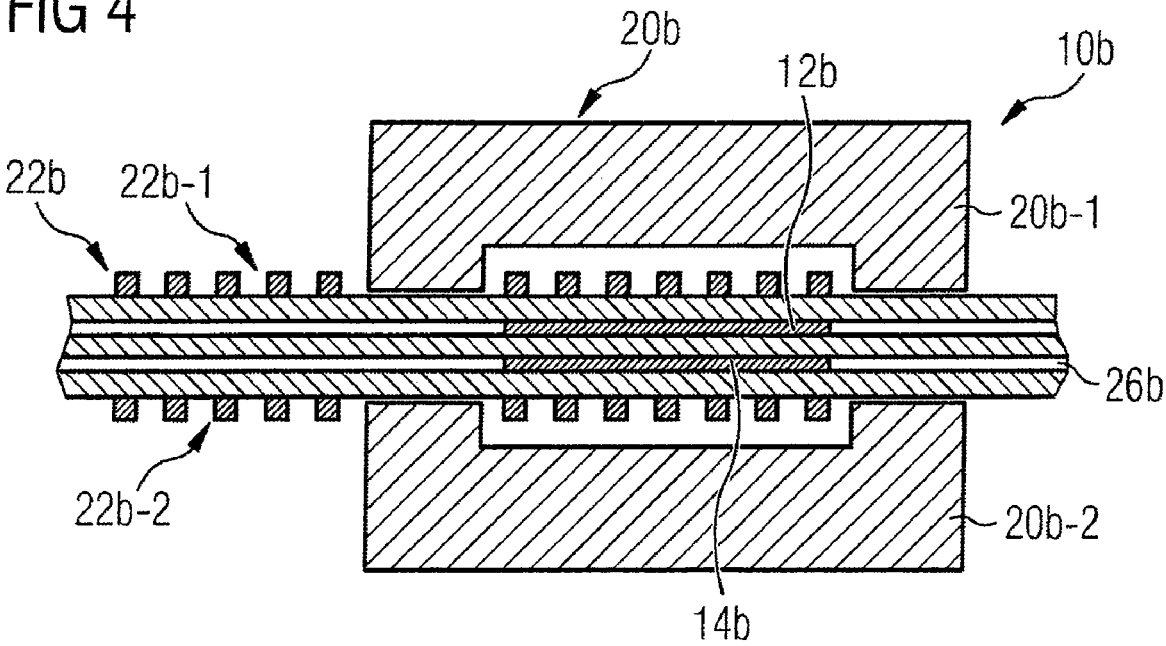
FIG. 4 is a cross-sectional view of some components of a controller according to a further embodiment.

For the practical implementation of the line sections 12, 14, the magnetic flux part 20, the detection coil arrangement 22 and their spatial disposition relative to one another, there are a wide variety of options. With reference to FIGS. 3 and 4, two exemplary embodiments will now be explained in which the above mentioned components are advantageously embodied in an area of a circuit board which is provided anyway in a controller as the interconnection substrate e.g. of the output stage.

In the following description of further exemplary embodiments, the same reference numerals will be used for components having the same effect, supplemented in each case by a lower-case letter to differentiate between the embodiments. Essentially, only the differences compared to the example(s) already described will be discussed and reference is otherwise made expressly to the description of previous examples.

FIG. 3 shows a multilayer circuit board 26*a* in which the line sections 12*a* and 14*a* provided for supplying current to the external electrical load (actuator) are implemented as a conductive trace of the circuit board 26*a* in each case. To the face of the circuit board 26*a* shown in FIG. 3 there is bonded a U-shaped magnetic flux part 20*a* whose central area extends in an elongated manner obliquely to the current flow directions (currents Ip1 and Ip2) and spanning the conductor sections 12*a*, 14*a* on said face.

To detect a magnetic flux variation in the magnetic flux part 20*a* occurring in the event of a fault, a detection coil 22*a* is provided which is permeated by the magnetic flux emerging at one end of the magnetic flux part 20*a* and which in this example is likewise implemented as a conductive trace.

The ends of the conductive trace coil 22*a* can be connected to a suitable evaluation circuit, likewise implemented on the circuit board 26*a*.

For particularly precise or reliable fault detection, possibly with quantification of a fault current as part of the evaluation, it is particularly advantageous if the magnetic flux components produced by the two current flows Ip1 and Ip2 largely or completely cancel one another out. Using the components shown in FIG. 3 alone, this is not yet the case. In a modification or rather a more specific embodiment, the degree of the mutual compensation is increased by a suitable symmetry of the arrangement. An example of this is shown in FIG. 4.

FIG. 4 shows a circuit board 26*b* with 4 interconnection layers which are disposed symmetrically about the central plane of the circuit board 26*b*, namely two outer interconnection layers on the board faces and two inner interconnection layers inside the circuit board 26*b*.

In the two inner layers, the line sections (outgoing and return line) 12*b*, 14*b* to the load are implemented in a straight line, relatively wide and parallel to one another. In the two outer layers, series-connected detection coils 22*b*-1 and 22*b*-2 having a large number of turns are implemented and constitute a detection coil arrangement 22*b*. A magnetic flux part 20*b* is made up of two half-rings 20*b*-1 and 20*b*-2 and is again attached to the circuit board 26*b* so that it spans the conductive trace sections 12*b*, 14*b*.

As can be seen from FIG. 4, the overall arrangement possesses a symmetry which itself, allowing for certain unavoidable dimensional tolerances in practice, results in virtually complete mutual elimination of the magnetic flux components in the magnetic flux ring 20*b*. The equal magnitude current flows in the line sections 12*b*, 14*b* result in equal but opposite magnetic fields in the magnetic flux part 20*b*.

The ends of the series circuit comprising the coils 22*b*-1 and 22*b*-2 are again connected to an evaluation circuit.

Since in this embodiment e.g. very simple copper traces present anyway on the primary side of the "differential current transformer" 12*b*, 14*b*, 20*b*, 22*b* can be used, the electrical losses can be minimized even with high RMS currents. On the secondary side (detection coil arrangement) there are normally no losses at all, as no current at all flows on the secondary side under normal operating conditions. Even in the event of a fault, appreciable power dissipation does not necessarily occur.

Depending on the "transformation characteristic" selected, a very high sensitivity to external fault currents can be achieved, without losing robustness and non-dissipativeness under normal operating conditions. No errors are caused by any current measurement conceivable in principle for the desired fault detection and subsequent analog difference calculation in an evaluation circuit. Amplifying or sensitive evaluation circuits are unnecessary for the "magnetic difference calculation" described here. The detection can be implemented very quickly, which is a major advantage for many applications.

In principle the components used for fault detection can also be implemented by discrete devices. However, the design solutions illustrated in FIGS. 3 and 4 involve considerably lower costs and particularly low electrical losses. In this connection it should be emphasized that the primary side of the "fault current transformer" can be subjected to relatively high currents without functional limitation, i.e. high and/or strongly varying voltages can be present between the two line sections. In the configuration shown, no additional soldered joints are required. By using a multilayer circuit board as shown in FIG. 4, a mechanically symmetrical design can be implemented in which the primary conductors are disposed congruently inside and the secondary sensing conductors are disposed likewise congruently outside, which considerably improves the detection characteristic. Notwithstanding the example shown, the functions of the inner and outer layers could also be transposed.

FIG. 5 once again illustrates in a circuit diagram the operation of the inventive fault detection system using the example of a controller for operating a plurality of fuel injectors for the internal combustion engine of a motor vehicle.

An output stage E shown here operates similarly to the charging and discharging device as disclosed e.g. in the publication DE 103 03 779 A1 mentioned in the introduction.

The output stage E comprises in per se known manner a series circuit consisting of a charging switch M1 and a discharging switch M2 each implemented as a controllable field effect transistor.

To this series circuit is applied an operating voltage which is defined by supply potentials Ub and GND e.g. at the output of a DC/DC converter of the vehicle electronics (e.g. Ub=200

V, GND=0 V), corresponding control signals s1 and s2 for these switches M1 and M2 being generated by a control unit ST and fed to the control inputs (gates) of the switches.

A center tap of the series circuit comprising M1 and M2 is connected in the manner shown via a choke L1 and a capacitor C6 and also via a line section 14*c* to an external line 18*c* leading to a piezo actuator Cp of an injector. Because of the potential variations produced on the line 18*c* by the switching of the transistors M1, M2, this line is generally also known as the "hot side", whereas a second line 16*c* likewise connected to the piezo actuator Cp constitutes a "ground line" which is connected to external ground GND via a so-called selector switch M6 and a line section 12*c*.

Figure 5:
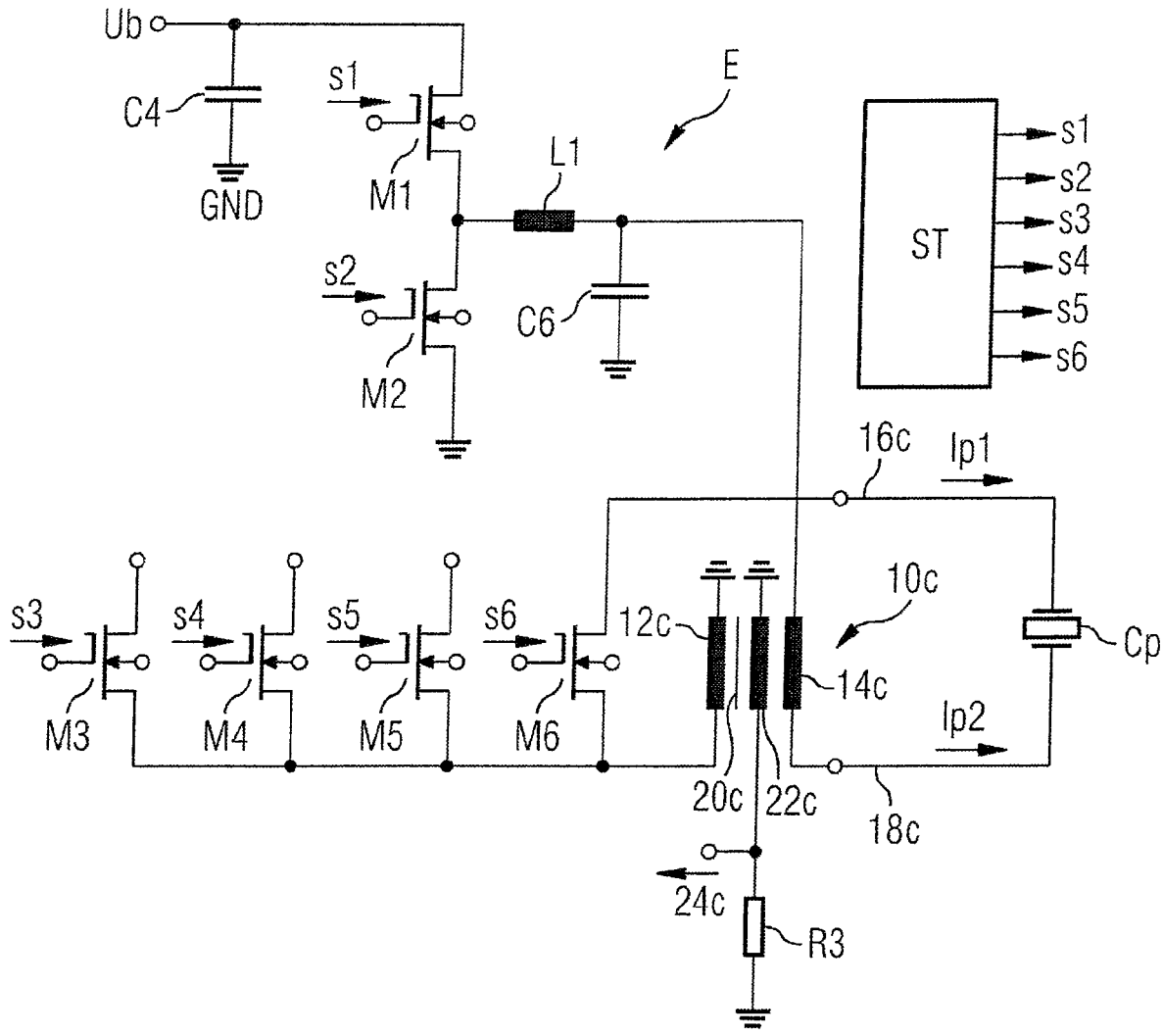
FIG. 5 is a circuit diagram of a controller according to another embodiment.

For simplicity of representation, only one piezo actuator Cp is shown in FIG. 5. Actually, further piezo actuators of other injectors are connected to the ground line section 12*c* via a selector switch arrangement consisting of the selector switch M6 and further selector switches M3, M4 and M5. The control unit ST also generates corresponding control signals s3 to s6 for these switches M3 to M6 which are implemented as field effect transistors, by means of which one of the piezo actuators can be selected for a charging or discharging process. In the example shown, the line 18*c* ("hot side") is used jointly for all these piezo actuators.

By means of the output stage E, during operation of the controller the piezo actuator Cp selected is supplied with current in a pulsed manner, currents Ip1 and Ip2 flowing via the two line sections 12*c*, 14*c* and the two external lines 16*c*, 18*c* respectively. These currents have the same absolute value, but flow in opposite directions (Ip2=−Ip1).

The two line sections 12*c*, 14*c* are disposed near a ferrite core 20*c* in such a way that magnetic flux components produced by the current flows in the two line sections 12*c*, 14*c* under these normal operating conditions essentially compensate each other. These line sections 12*c*, 14*c* are shown as coils in FIG. 5. This serves to illustrate their function of applying corresponding magnetic field components to the ferrite core 20*c*. In the simplest case, however, these line sections 12*c*, 14*c* are implemented as simple line sections e.g. running parallel to one another in a straight line, as has already been described above with reference to FIGS. 3 and 4. This also constitutes the preferred embodiment of the line sections. However, it is by no means impossible for these line sections 12*c*, 14*c*, as shown in FIG. 5, to be actually implemented as line sections or coils wound around a magnetic flux part (ferrite core). It is merely essential that during normal operation the magnetic flux components produced thereby in the magnetic flux part 22*c* essentially compensate each other. In this case the voltage induced in a detection coil 22*c* is essentially zero.

In the event of a fault in which the absolute values of the currents Ip1 and Ip2 are significantly different, a resulting pulsating magnetic flux is produced in the ferrite core 22*c* and consequently an induction voltage at the coil 22*c* (which is e.g. wound around the ferrite core 22*c*). On the basis of evaluation of this induced voltage, detection of the fault resulting e.g. in the output stage E in the controller being shut down is then performed in an evaluation unit 24*c* (not shown).

In the example shown, the induced voltage is evaluated by measuring a voltage drop across a resistor R3 connected in series with the detection coil 22*c*.

Figure 6:
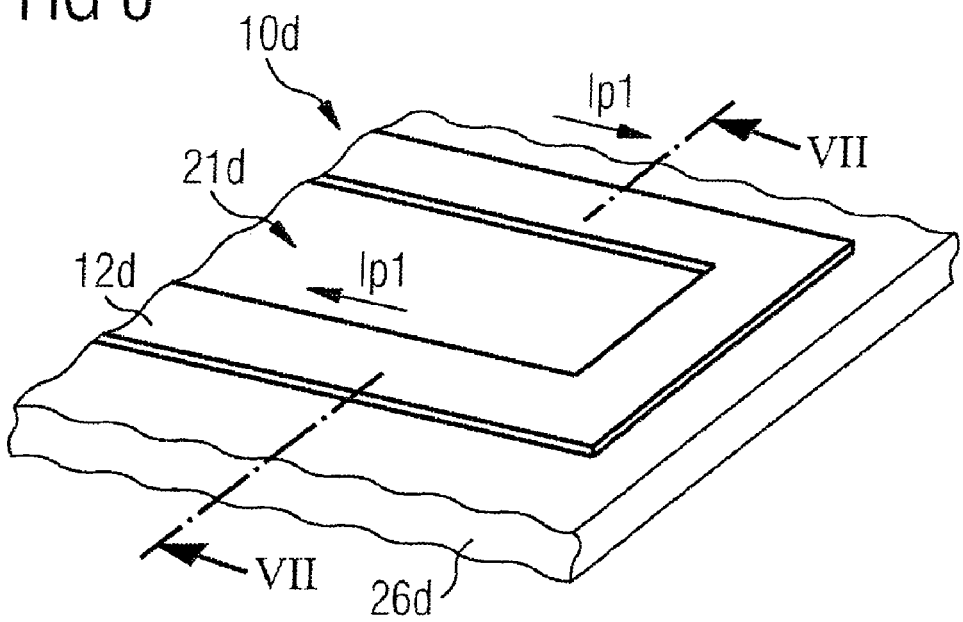
FIG. 6 is a perspective view of some components of a detection arrangement according to a further embodiment.
Figure 7:
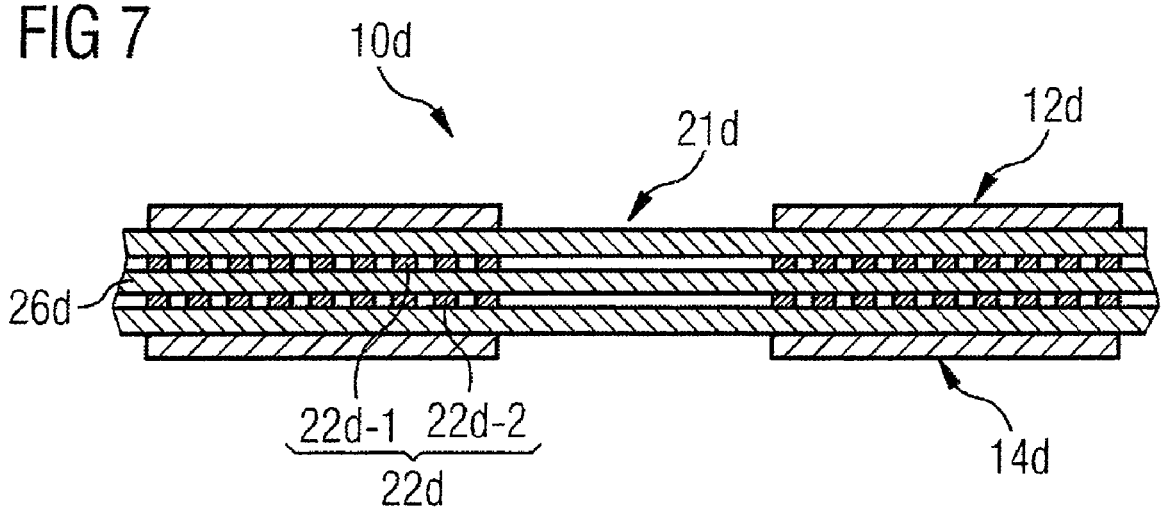
FIG. 7 is a cross-sectional view along the line VII-VII in FIG. 6.

FIGS. 6 and 7 are views corresponding to FIGS. 3 and 4 of another embodiment of a fault detection arrangement 10*d*.

In contradistinction to the embodiments described above, the magnetic flux part can be dispensed with here. Accordingly, by means of a detection coil arrangement 22*d* here consisting of two series-connected detection coils 22*d*-1 and 22*d*-2, it is not a magnetic flux concentrated in a magnetic flux part that is detected but the superimposition of the magnetic field components produced directly by the current flow in line sections 12*d*, 14*d* in a spatial area 21*d*.

As shown in FIG. 6, the "outgoing" Ip1 flows through the line section 12*d* implemented in a U-shaped manner on one face of the circuit board 26*d*. The "return current" Ip2 of equal absolute value flows in the line section 14*d* disposed congruently on the underside of the circuit board 26*d* (in the opposite direction). By means of this conductive trace arrangement, there is generated by each of the line sections 12*d*, 14*d*, in the area between the legs of the U, a magnetic flux component which is oriented essentially orthogonally to the plane of the circuit board. During normal operation, the two magnetic flux components compensate each other.

By being inside the circuit board 26*d*, the detection coil arrangement 22*d* provided for fault detection is advantageously shielded from interfering fields by the line sections 12*d*, 14*d* disposed above and below it.

To summarize, the examples described relate to a controller for operating at least one fuel injector, comprising an output stage provided on the output side with a first line section (12) and a second line section (14) for supplying current (Ip1, Ip2) in a pulsed manner to an electric actuator (load) via an external line pair (16, 18) which can be connected to the two line sections (14, 16). In order to simplify the reliable detection of operating faults, there is provided according to the invention a detection coil arrangement (22) for detecting operating faults on the basis of evaluation (24) of a voltage induced on the detection coil arrangement, the detection coil arrangement (22) being permeated by a magnetic flux made up of the magnetic flux components produced by the current flows (Ip1, Ip2) in the two line sections (14, 16), and mutual compensation of the magnetic flux components being provided during normal operation. These measures are particularly reliable in practice and can be implemented in a simple and robust manner.

The invention claimed is:

1. A controller for operating at least one injector for injecting fuel into a combustion chamber of an internal combustion engine, the controller comprising:

an external line pair;

an output side having an output stage, said output stage including:

a magnetic flux part;

a first line section and a second line section for supplying current in a pulsed manner to an electric actuator of the injector via said external line pair being connectable to said first and second line sections, said first and second line sections running near said magnetic flux part such that magnetic flux components produced in said magnetic flux part by current flows in said first and second line sections during normal operation generally compensate each other; and a detection coil configuration permeated by the magnetic flux of said magnetic flux part for detecting operating faults on a basis of evaluation of a voltage induced on said detection coil configuration.

2. The controller according to claim 1, wherein said magnetic flux part is made of magnetically soft material.

3. The controller according to claim 1, wherein said magnetic flux part is implemented such that it surrounds said first and second line sections in a generally annularly closed manner.

4. The controller according to claim 1, further comprising a circuit board and said magnetic flux part has at least one section mounted to said circuit board.

5. The controller according to claim 1, wherein:

said first and second line sections run such that the magnetic flux components produced by the current flows in said first and second line sections during normal operation generally cancel each other out in a spatial area adjacent to said first and second line sections; and said detection coil configuration permeated by the magnetic flux in said spatial area detects operating errors on a basis of evaluation of the voltage induced on said detection coil configuration.

6. The controller according to claim 1, wherein, when current is supplied to the actuator, said output stage produces a voltage between said first and second line sections being at least periodically greater than 100 V under normal operating conditions.

7. The controller according to claim 1, wherein, when current is supplied to the actuator, said output stage generates a current flowing between said first and second line sections being at least periodically greater than 2 A under normal operating conditions.

8. The controller according to claim 1, wherein, when current is supplied to the actuator, said output stage generates a pulse frequency being at least periodically greater than 10 kHz under normal operating conditions.

9. The controller according to claim 1, further comprising a selector switch configuration for optionally connecting at least one of said first and second line sections to a part of said external line pair.

10. The controller according to claim 1, wherein said first and second line sections are implemented symmetrically with respect to one another.

11. The controller according to claim 1, wherein said first and second line sections are implemented as conductive traces of a circuit board.

12. The controller according to claim 1, wherein said detection coil configuration contains at least one detection coil formed by a conductive trace of a circuit board.

13. The controller according to claim 1, further comprising a resistive element; and wherein said detection coil configuration has a detection coil, the evaluation of the voltage induced involves measuring a voltage drop across said resistive element connected in series with said detection coil of said detection coil configuration.

* * * * *